US007576696B2

(12) United States Patent
Walton et al.

(10) Patent No.: US 7,576,696 B2
(45) **Date of Patent: *Aug. 18, 2009**

(54) MULTI-BAND ANTENNA

(75) Inventors: Eric K. Walton, Columbus, OH (US); Eugene Y. Lee, Columbus, OH (US); Bruce Montgomery, Columbia, MD (US)

(73) Assignees: Syntonics LLC, Columbia, MD (US); The Ohio State Research Foundation, Columbus, OH (US)

( * ) Notice: Subject to any disclaimer, the term of this patent is extended or adjusted under 35 U.S.C. 154(b) by 330 days.

This patent is subject to a terminal disclaimer.

(21) Appl. No.: 11/457,327

(22) Filed: Jul. 13, 2006

(65) Prior Publication Data

US 2007/0132657 A1 Jun. 14, 2007

Related U.S. Application Data

(63) Continuation-in-part of application No. 11/325,365, filed on Jan. 4, 2006, now Pat. No. 7,239,291.

(60) Provisional application No. 60/641,403, filed on Jan. 5, 2005, provisional application No. 60/704,588, filed on Aug. 2, 2005.

(51) Int. Cl.
*H01Q 1/38* (2006.01)

(52) U.S. Cl. ..... 343/700 MS; 343/909; 343/853

(58) Field of Classification Search ..... 343/909, 343/756, 700 MS, 853
See application file for complete search history.

(56) References Cited

U.S. PATENT DOCUMENTS

| | | | | |
|---|---|---|---|---|
| 5,160,936 | A | 11/1992 | Braun et al. | |
| 5,485,167 | A | 1/1996 | Wong et al. | |
| 5,949,387 | A | 9/1999 | Wu et al. | |
| 5,982,339 | A | 11/1999 | Lalezari et al. | |
| 6,121,931 | A * | 9/2000 | Levi | 343/700 MS |
| 6,452,549 | B1 | 9/2002 | Lo | |
| 6,608,607 | B2 | 8/2003 | Wu | |
| 6,747,608 | B2 | 6/2004 | Wu | |
| 6,774,866 | B2 | 8/2004 | McKinzie, III et al. | |
| 6,822,622 | B2 | 11/2004 | Crawford et al. | |
| 6,891,514 | B1 | 5/2005 | Henry et al. | |
| 2004/0100418 | A1 | 5/2004 | Best et al. | |

* cited by examiner

*Primary Examiner*—Trinh V Dinh
*Assistant Examiner*—Dieu Hien T Duong
(74) *Attorney, Agent, or Firm*—Dinsmore & Shohl LLP

(57) ABSTRACT

Antenna assemblies and corresponding modes of operation are provided where the first antenna assembly of the system is tuned to a first frequency band ν1 and the second antenna assembly of the antenna system is tuned to a second frequency band ν2. The ground plane of the first antenna assembly is configured as a frequency selective surface that is substantially reflective of radiation in the first frequency band and substantially transparent to radiation in the second frequency band. The second ground plane may also be configured as a frequency selective surface and may be reflective of radiation in the second frequency band. Any number of additional antenna arrays may be added so long as the outer arrays are transparent to the inner arrays.

36 Claims, 9 Drawing Sheets

MULTI-BAND ANTENNA

CROSS-REFERENCE TO RELATED APPLICATIONS

This application claims the benefit of U.S. Provisional Application Ser. No. 60/704,588, filed Aug. 2, 2005.

This application is a continuation-in-part of U.S. patent application Ser. No. 11/325,365, filed Jan. 4, 2006, which claims the benefit of U.S. Provisional Application Ser. No. 60/641,403, filed Jan. 5, 2005.

STATEMENT REGARDING FEDERALLY SPONSORED RESEARCH OR DEVELOPMENT

This invention was made with government support under Small Business Innovation Research SPAWAR Contract Nos. N00039-03-C-0078 and N00039-04-C-0031. The Government has certain rights in this invention.

BACKGROUND OF THE INVENTION

The present invention relates to the design and operation of antennae capable of operating in multiple bands.

BRIEF SUMMARY OF THE INVENTION

According to the present invention, antenna assemblies and corresponding modes of operation are provided where the antenna system comprises at least two antenna assemblies. The first antenna assembly of the system is tuned to a first frequency band $\nu_1$ and comprises a first array of antenna elements, a first electrical ground plane electromagnetically coupled to the first array of antenna elements, and a first transmission network conductively coupled to the first array of antenna elements. The second antenna assembly of the antenna system is tuned to a second frequency band $\nu_2$. The first ground plane is configured as a frequency selective surface that is substantially reflective of radiation in the first frequency band and substantially transparent to radiation in the second frequency band. The first transmission network may be configured such that it is substantially transparent to radiation in the second frequency band. According to the present invention, any number of additional antenna arrays may be added so long as the outer arrays are transparent to any inner arrays.

According to methods of operating antenna systems provided herein, respective fields of view defined by the respective antenna assemblies of the antenna system are oriented independently. The respective fields of view may be oriented such that a given antenna assembly partially obstructs the field of view of an additional antenna assembly within the system or where the degree to which one antenna assembly obstructs the field of view of the other varies, although it is noted that the present invention is not limited to embodiments where there is obstruction. Similarly, it is contemplated that the present invention is not limited to antenna systems where there is relative movement between the respective fields of view defined by the antenna assembly. For example, it is contemplated that embodiments of the present invention may be characterized by substantially complete, full-time obstruction of one antenna assembly by another antenna assembly.

Accordingly, it is an object of the present invention to provide improved antenna assemblies and corresponding modes of operation. Other objects of the present invention will be apparent in light of the description of the invention embodied herein.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
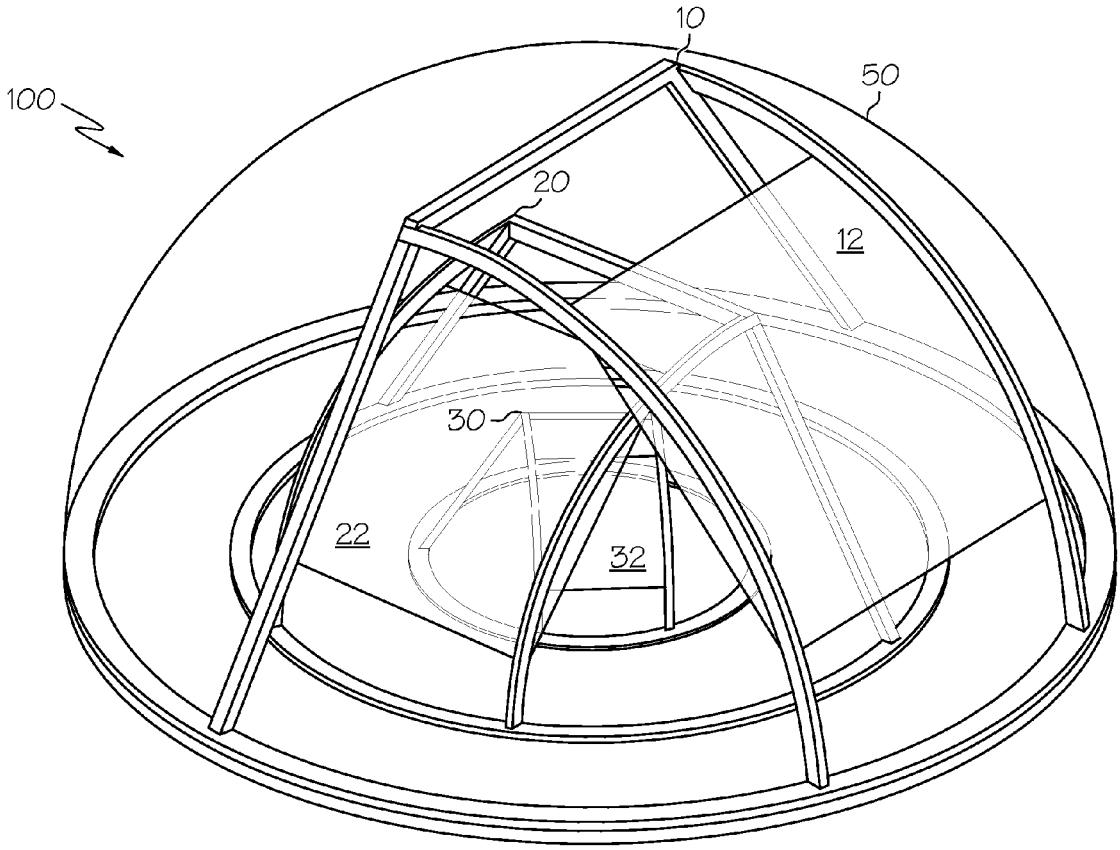
FIG. 1 is a general schematic illustration of an antenna layout according to one embodiment of the present invention.
Figure 2:
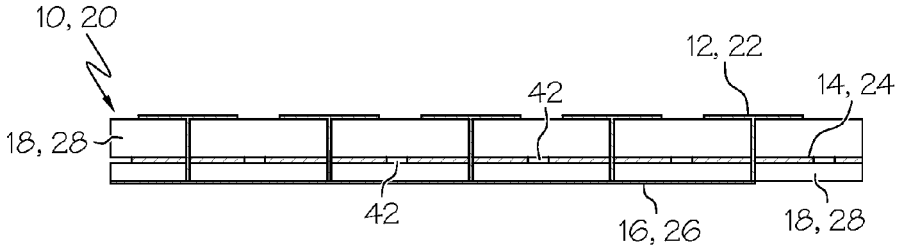
FIG. 2 is a cross-sectional view of a FSS-supported antenna array in accordance with one embodiment of the present invention.

Referring initially to FIG. 1, an antenna system 100 is provided comprising a plurality of independent antenna assemblies 10, 20, 30. Each antenna assembly 10, 20, 30 is tuned to a particular frequency band $\nu_1$, $\nu_2$, $\nu_3$ and comprises an array of antenna elements, an electrical ground plane, and a transmission network coupled to the array of antenna elements. More specifically, FIG. 2 illustrates the primary components of an antenna assembly 10, 20, 30 according to the present invention. The antenna assembly 10, 20, 30 and its components are identified in FIG. 2 using sets of reference numbers in the 10s, 20s, and 30s to signify that the illustrated structure will generally apply to the construction of any or all of the separate antenna assemblies 10, 20, 30 illustrated in FIG. 1. FIGS. 1 and 2 are for illustration, as there is no upper limit on the number of antennas that can be included when utilizing this structure.

Referring to FIG. 2, the assembly is configured such that an electrical ground plane 14 and 24 is electromagnetically coupled to an array of antenna elements 12 and 22 across a dielectric layer 18 and 28. A transmission network 16 and 26 is conductively coupled to each antenna element of the first array of antenna elements 12 and 22. The ground plane 14 and 24 is configured as a frequency selective surface that is substantially reflective of radiation in the frequency band to which the antenna elements are tuned and substantially transparent to radiation in frequency bands to which any underlying antenna assemblies are tuned. In this manner, a multi-band antenna system that can simultaneously receive and transmit in multiple bands can be constructed by consolidating a plurality of independent antenna assemblies 10, 20, 30 into a single multi-band antenna structure. More specifically, three independent antenna arrays, each designed for reception in a distinct band (e.g., the L, S, and X-bands), can be incorporated into a single antenna structure by providing ground planes 14 and 24 configured as frequency selective surfaces.

As is illustrated in FIG. 1, the antennas can be packaged with overlapping fields of view using a mechanical design that nests three independently positional antenna arrays 10, 20, 30 into a single package within a single radome 50. By configuring each antenna assembly 10, 20, 30 in the manner illustrated, the frequency tuning of each antenna assembly is not dependent upon any component or components of the other antenna assemblies in the system 100. Further, the operation of each antenna assembly 10, 20, 30 is substantially independent of the relative position of the other antenna assemblies within the system 100. As is illustrated schematically in FIG. 1, an antenna system 100 according to the present invention can be configured such that the first, second, and third antenna assemblies 10, 20, 30 define respective fields of view that can be oriented independently of each other through relative movement of the antenna assemblies within the radome 50 of the antenna system 100.

To optimize operation, the respective ground planes 14 and 24 of the first and second antenna assemblies 10 and 20 can be configured as frequency selective surfaces that will be substantially reflective of radiation in the frequency band to which the particular antenna assembly is tuned and substantially transparent to radiation in the frequency bands of any underlying antenna assemblies. In this manner, the antenna system 100 can be configured such that the first antenna assembly 10 may be positioned to obstruct the field of view of the second antenna assembly 20 without substantially degrading the functionality of the second antenna assembly 20. Similarly, the first and second antenna assemblies 10, 20 may be positioned to obstruct the field of view of the third antenna assembly 30 without substantially degrading its performance. Further, the respective functionality of each antenna assembly 10, 20, 30 will be substantially entirely independent of the degree to which one antenna assembly obstructs the field of view of the others. In this manner, the operation of the antenna system as a whole will be largely unaffected by the relative positions of the antenna assemblies as they are moved within the radome 50. It is contemplated that many additional antenna assemblies may be added in accordance with the present invention so long as the outer arrays are transparent to the inner arrays.

For example, and not by way of limitation, according to one embodiment of the present invention, the first antenna assembly 10 can be configured as an L-Band antenna characterized by a first frequency band $\nu_1$ at least partially falling within the range of between about 0.39 GHz and about 1.75 GHz. The second antenna assembly 20 can be configured as an S-Band antenna characterized by a second frequency band $\nu_2$ at least partially falling within the range of between about 1.75 GHz and about 5.20 GHz. The third antenna assembly 30 can be configured as an X-Band antenna characterized by a third frequency band $\nu_3$ at least partially falling within the range of between about 5.20 GHz and about 10.9 GHz. More specifically, the first frequency band $\nu_1$, may extend from about 1.65 GHz and about 1.75 GHz, the second frequency band $\nu_2$ may extend from about 2.205 GHz to about 2.255 GHz, and the third frequency band $\nu_3$ may extend from about 7.45 GHz to about 7.85 GHz. The innermost X-band does not require a frequency selective surface and may utilize any suitable antenna design.

Figure 3A:
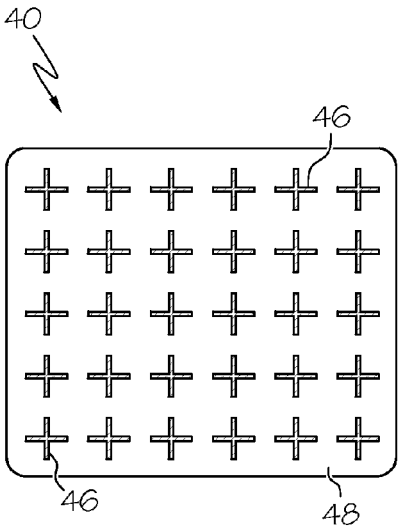
FIGS. 3A and 3B illustrate two different types of periodic surfaces for use in designing frequency selective surfaces for use in accordance with the present invention.
Figure 3B:
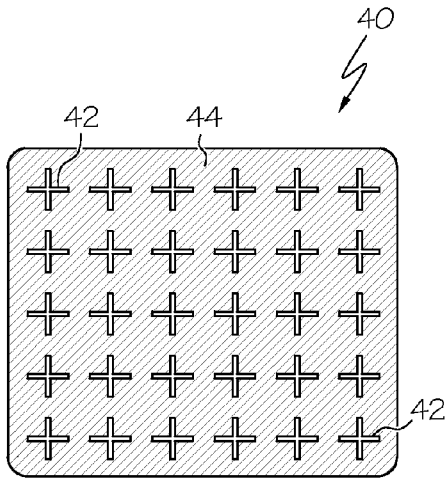

The frequency selective surfaces of the respective ground planes 14 and 24 can be arranged as a periodic, one or two-dimensional array of substantially identical ground plane elements. For example, referring to FIGS. 3A and 3B, the ground plane elements may comprise conductive elements 46 supported by a dielectric structure 48 or slot elements 42 formed in a conductive layer 44. Conductive elements 46 may comprise a conductive wire, patch or any suitable conductive element. Suitable reflection or transmission bands for each frequency selective surface can be established by choosing particular slot or element sizes and periodicities according to the well-established principles of frequency selective surface design. A number of generally suitable frequency selective surface configurations are described herein and should be taken as illustrative and non-limiting. For example, referring to FIG. 9, a frequency selective surface according to one embodiment of the present invention, comprises conductive elements 46 in the form of a wire-cross periodic surface supported by a dielectric structure. The L-band frequency selective surface may be crossed wire dipoles which are not touching.

Figure 4:
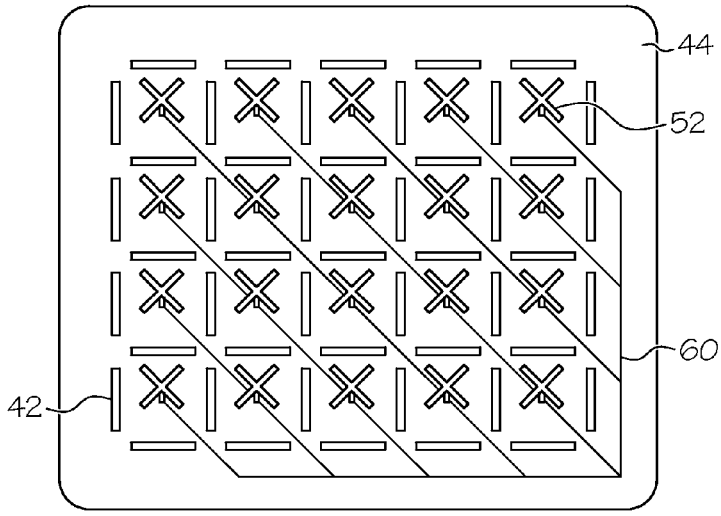
FIG. 4 is a plan view of a FSS-supported antenna array in accordance with one embodiment of the present invention.
Figure 9:
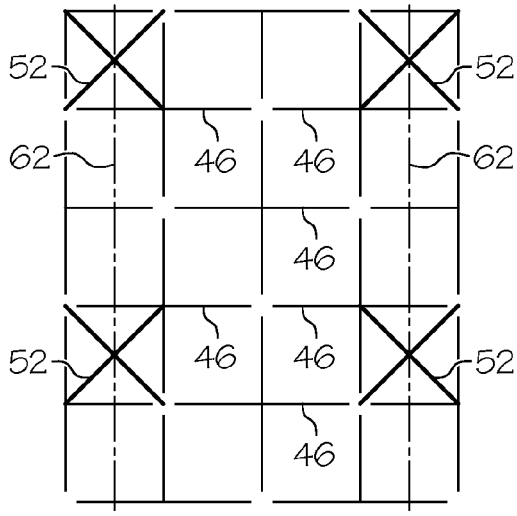
FIG. 9 is a plan view of a FSS-supported L-band antenna array in accordance with one embodiment of the present invention.

Referring collectively to the two different antenna assembly configurations illustrated in FIGS. 4 and 9, according to one aspect of the present invention, the frequency selective characteristics of antenna assemblies according to the present invention can be optimized by ensuring that the antenna elements 52 of the antenna array are positioned to avoid overlap with the ground plane elements 42, 46 of the frequency selective surface ground plane. Similarly, to avoid power leakage, the conductive lines 62 of the transmission network 60 can be configured to avoid overlap with the ground plane elements 42, 46. For the purposes of describing and defining the present invention, it is noted that the above-noted "overlap" is taken from a perspective along an orthogonal linear projection of a portion of a transmitted or received electromagnetic signal. For example, overlapping ground plane and antenna elements would both include portions that lie along a single linear projection of a portion of a transmitted or received electromagnetic signal, taken along a path generally orthogonal to the plane of the antenna assembly or, in the case of an antenna assembly with a curved surface profile, taken along a path generally orthogonal to a planar tangential surface of the antenna assembly.

As is illustrated in FIG. 2, antenna assemblies according to the present invention can be configured as a unitary multi-layer structure comprising, as multi-layer structural components, the array of antenna elements 12 and 22, the electrical ground plane 14 and 24, the transmission network 16 and 26, and one or more dielectric layers 18 and 28. This mode of construction is particularly advantageous because it provides a convenient means by which the dielectric gap spacing the ground plane 14 and 24 from the array of antenna elements 12 and 22 can be established. For example, in many instances it will be preferable to ensure effective grounding by setting the dielectric gap at less than the wavelength of the particular frequency band of interest. More preferable, the dielectric gap is set at about one-quarter of a wavelength of the frequency band of interest. The quarter wavelength spacing is typically chosen to let the ground plane become effective and allow in-phase addition of directly emitted and ground plane reflected waves.

Figure 5A:
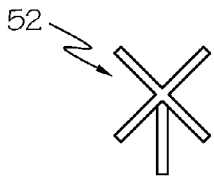
FIGS. 5A-5C illustrate a selection of suitable antenna elements according to the present invention.
Figure 5B:
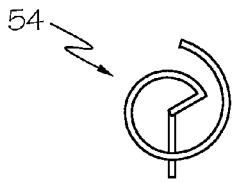
Figure 5C:
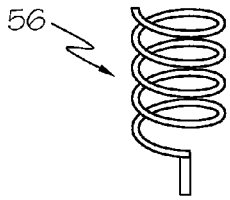
Figure 6:
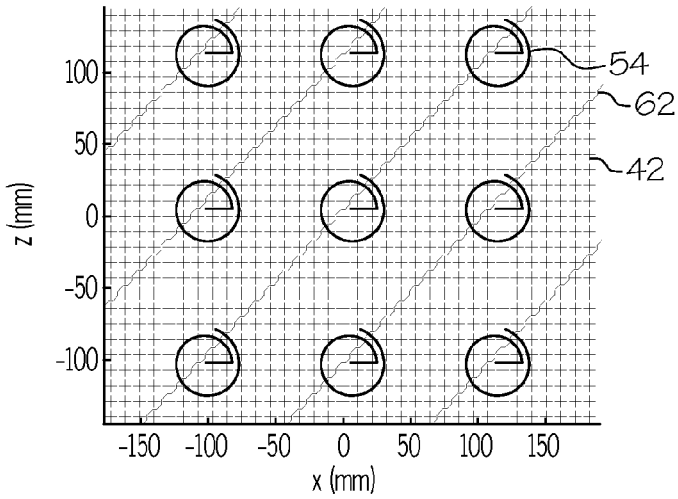
FIG. 6 a plan view of a FSS-supported S-band antenna array in accordance with one embodiment of the present invention.

Although the antenna elements of the antenna assemblies 10, 20, 30 according to the present invention may take a variety of forms, it is noted that suitable antenna element configurations include crossed dipole antenna elements 52 (see FIG. 5A), curl antenna elements 54 (see FIG. 5B), and helical antenna elements 56 (see FIG. 5C). It is noted that the cross dipole 52 and the curl 54 can be conveniently printed on a PC board. In addition, it is noted that particular embodiments of the present invention can employ bended dipole antenna elements 58 (see FIG. 11) or circular dipole antenna elements 59 (see FIG. 11). It is also noted that antenna elements suitable for use in accordance with the present invention may be selected such that the antenna assemblies support circular polarization, often required for satellite communication. Finally, according to one aspect of the present invention, antenna elements can be configured as rotatable curl antenna elements, where rotation of the antenna element about an axis orthogonal to the plane of the antenna array alters the phase of the transmitted or received signal. In this manner, the antenna assembly can be configured to provide uniform phase shift across the antenna array without the necessity of correcting for phase shift in the transmission line network of the array.

Although the transmission network of the antenna assemblies 10, 20, 30 according to the present invention may take a variety of forms, it is noted that suitable transmission network configurations may comprise a network of micro-strip or co-planar waveguide transmission lines configured to utilize the conductive layer of the ground plane as an electrical ground. Such a configuration is illustrated schematically in FIGS. 7 and 8. Alternatively, where the ground plane comprises an array of conductive elements supported by a dielectric structure, a suitable transmission network may comprises a co-axial cable network or a network of transmission lines implemented as components of a unitary multi-layered structure, similar to a printed circuit board, in the antenna assembly. Such a configuration is illustrated schematically in FIG. 9.

Figure 7:
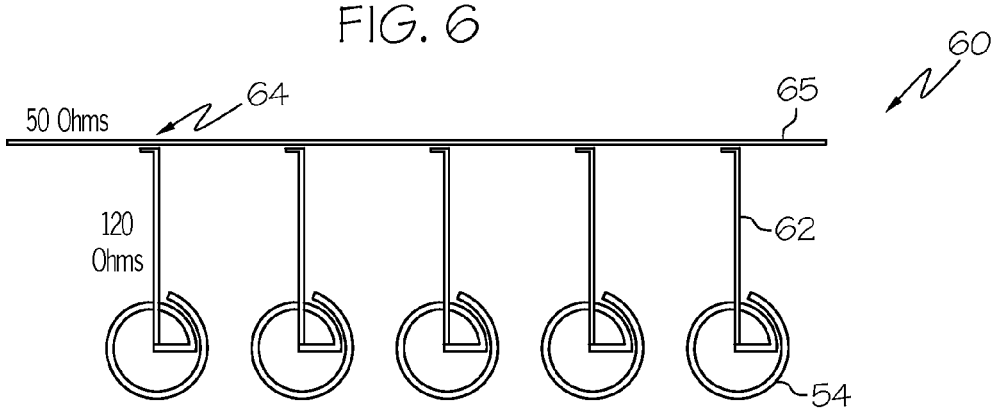
FIGS. 7 and 8 illustrate two alternative transmission line feed schemes for an S-band antenna array according to the present invention.

In the embodiment illustrated in FIG. 7, the transmission network 60 comprises directional couplers 64 through which individual elements 54 of the antenna array tap (i.e., distribute) energy from a primary feed line 65 of the network 60. The amount of energy coupled to the network of transmission lines can be controlled across the network 60 by controlling the length of the directional coupler and its spacing to the primary line 65. By way of illustrationm, and not limitation, it is noted that the primary feed line 65 is illustrated as a 50 ohm transmission line while the individual lines feeding each antenna element comprise 120 ohm lines.

Figure 8:
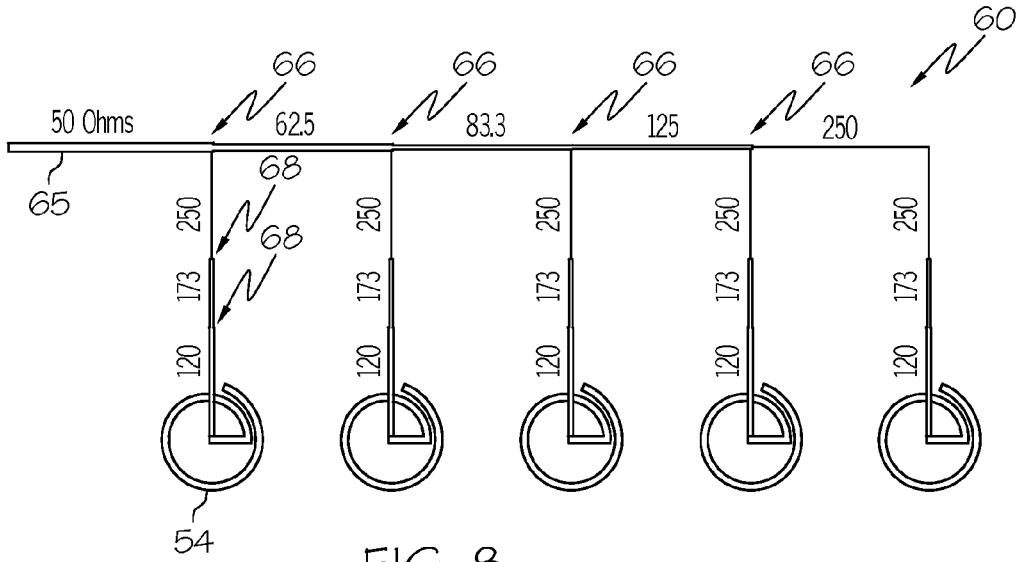

In the embodiment illustrated in FIG. 8, the transmission network 60 comprises T-junction power dividers 66 through which individual elements of the antenna array tap energy from the primary feed line 65 of the network 60. The T-junction power dividers 66 are configured with varying degrees of power ratio division between the primary feed line 65 and respective antenna elements 54 across the antenna element array. The first transmission network 60 may further comprise quarter wavelength transformers 68 through which individual elements 54 of the antenna array tap energy from the primary feed line 65 of the network 60. As is illustrated in FIG. 8, the T-junction power dividers 66 can be used to properly distribute input energy and the quarter wavelength transformers can be configured to bridge impedance gaps of different sections of the antenna array. More specifically, by way of illustration and not limitation, in FIG. 8, step transitions in the transmission lines are used to match the 50 ohm primary feed line 65 to the 120 ohm antenna elements. The illustrated configuration starts with 50 ohms, splits 62.5/250 ohms, then splits 83.3/250 ohms, then splits 125/250 ohms and finally splits 250/250 ohms. The lines feeding each antenna element have transitions stepping from 250 ohms to 173 ohms to 120 ohms. In this manner, equal distribution of RF power to each antenna element is achieved. The configuration also results in impedance matching to each antenna element.

Figure 10A:
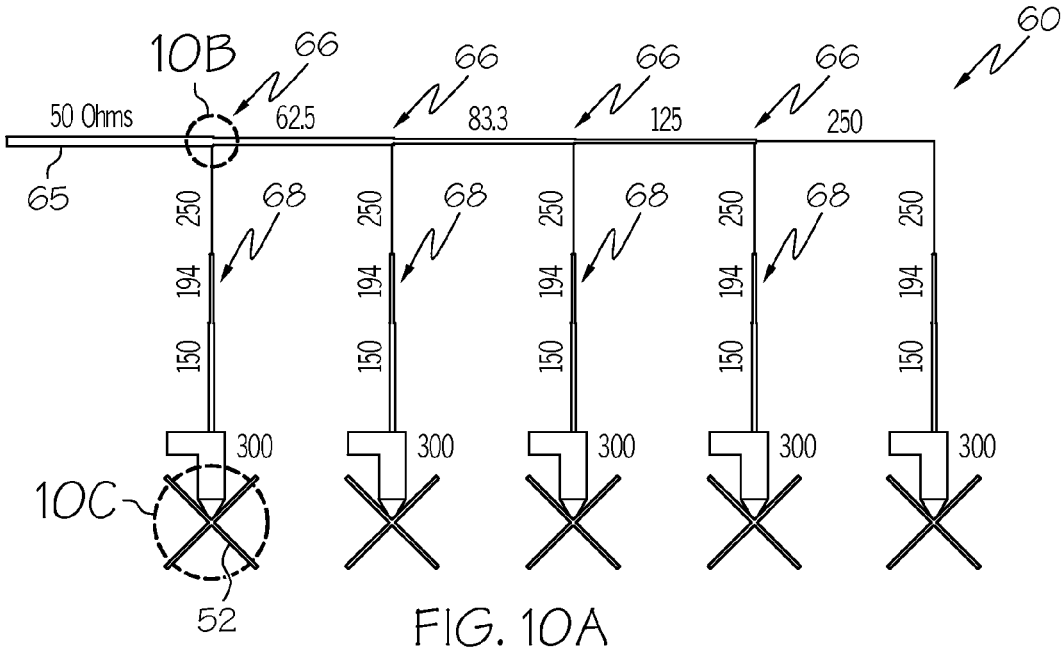
FIGS. 10 and 11 illustrate alternative transmission line feed schemes for an L-band antenna array according to the present invention.
Figure 10B:
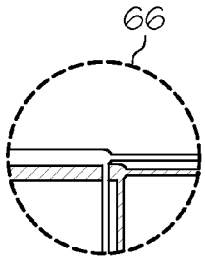
Figure 10C:
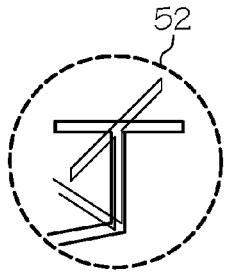

Referring to FIGS. 10A-C, a transmission network similar to the one illustrated in FIG. 8 is illustrated, with the exception that the micro-strip transmission line of the FIG. 8 embodiment is replaced by two-lead wires printed on the top and the bottom of the transmission line layer of a unitary multi-layer structure similar to a printed circuit board (see FIG. 10B). A power splitting scheme similar to that illustrated in FIG. 8 is shown in FIG. 10A. Specifically, the transmission lines have impedance jumps that yield power divisions matched to the needs of equal power to each radiating element. Furthermore, the curl element of FIG. 8 is replaced by two folded cross dipoles 52.

The folded dipole configuration of FIGS. 10A-C is used for its relatively high input impedance that avoids abrupt changes in transmission line characteristic impedance. The dipole antenna 52 is often more suitable where a balanced feed is ready from a two-lead primary feed line 65. As is illustrated in FIG. 10C, a second set of dipoles can be provided to support cross-polarized waves. Specifically, referring to FIGS. 10A and 10C, the antenna element 52 comprises a 300 ohm folded dipole antenna element and a 300 ohm twin line transmission line. A 90-degree phase delay line, illustrated in FIG. 10A as a 300 ohm segment, can be added for the feed of the second dipole to yield circular polarization.

Figure 11:
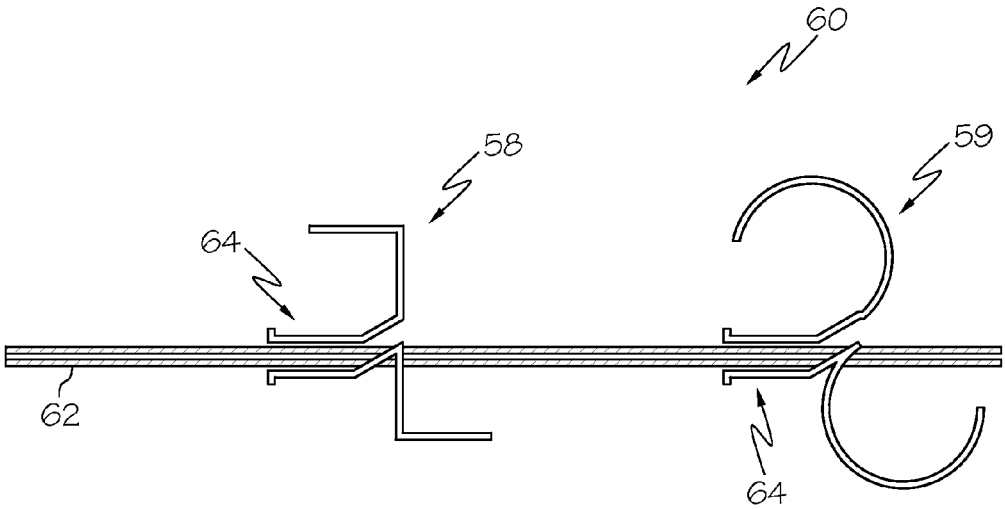

An alternative feed scheme and applicable radiation elements are illustrated in FIG. 11, where a co-planar stripline 62 is used with directional couplers 64 to tap energy from the primary feed line and direct it to respective upright two-lead wires of a bended dipole antenna element 58. The bended dipoles 58 are designed to handle circular polarization through radiations from dipole segments of different orientations. Alternatively, it is contemplated that a circular dipole 59, illustrated in FIG. 11, can also be used to handle circular polarization.

Figure 12:
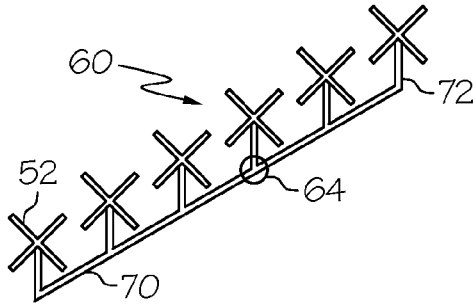
FIG. 12 illustrates a transmission network scheme in accordance with one embodiment of the present invention.

The transmission network 60 of antenna assemblies 10 and 20 may be configured to be substantially transparent to radiation in the frequency bands of any underlying antenna assemblies. For example, in an alternative feed scheme according to the present invention illustrated in FIG. 12, the transmission network 60 comprises secondary feed lines 72 that are coupled to a primary feed line 70 via couplers 64. The couplers 64 are connected in series along the primary feed line 70. The secondary feed lines 72 are connected to antenna elements 52. The dipole antenna element 52 in FIG. 12 is for illustration purposes only. For example, antenna elements as illustrated in FIGS. 5B, 5C and 11 may also be utilized. The secondary feed lines 72 may comprise a vertical microstrip transmission line. The secondary feed line 72 may also comprise upright two-lead wires of which are connected to an antenna element 52 as described above and as illustrated in FIG. 10B. It is apparent that other methods of connecting the antenna element 52 to the coupler are possible.

Figure 13:
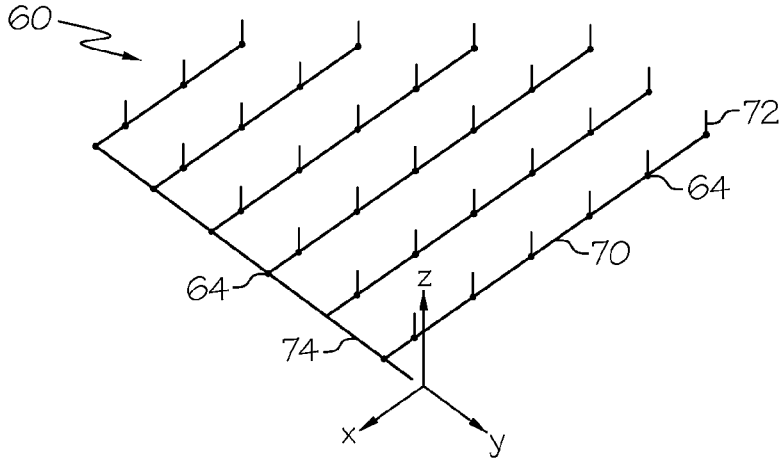
FIG. 13 illustrates a transmission network scheme in accordance with one embodiment of the present invention.

In another feed scheme according to the present invention illustrated in FIG. 13, the transmission network 60 comprises several primary feed lines 70 that are coupled to a main feed line 74 via couplers 64. The couplers 64 are connected in series along the main feed line 74. Secondary feed lines 72 are coupled to the primary feed lines 70 via couplers 64. The couplers 64 are connected in series along the primary feed lines 70. The secondary feed lines 72 are then connected to individual antenna elements.

Figure 14:
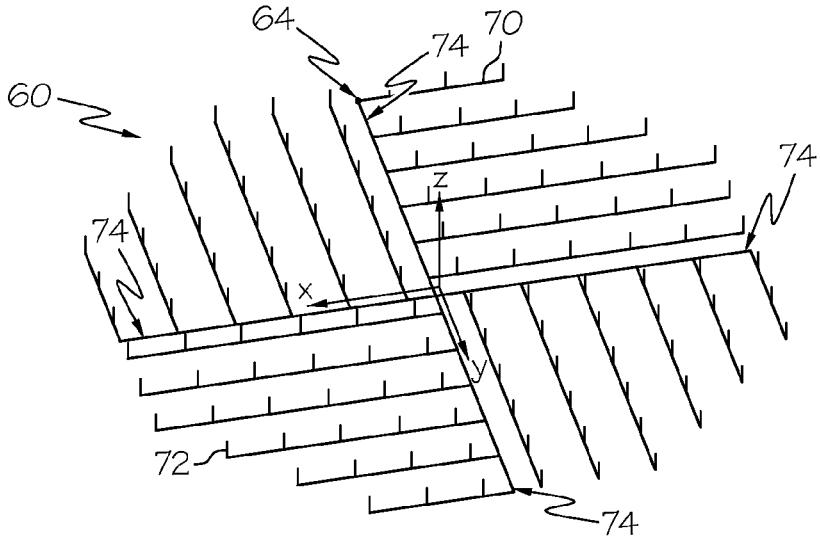
FIG. 14 illustrates a transmission network scheme in accordance with one embodiment of the present invention.

In another feed scheme illustrated in FIG. 14, the transmission network 60 comprises four quarter-panel sections that may be fed individually, or fed via a four-way power divider located at the center of the network. In one embodiment according to the present invention, the quarter panel sections are orthogonally joined by the four-way power divider. Each quarter panel section comprises several primary feed lines 70 that may be coupled to a main feed line 74 via couplers 64. Secondary feed lines 72 are then coupled to primary feed lines via couplers 64 that are connected in series along the primary feed lines 70. In another embodiment according to the present invention, the four quadrants may be fed individually. The signals from the four quadrants may thereby be used separately, for example, for monopulse tracking.

Figure 15:
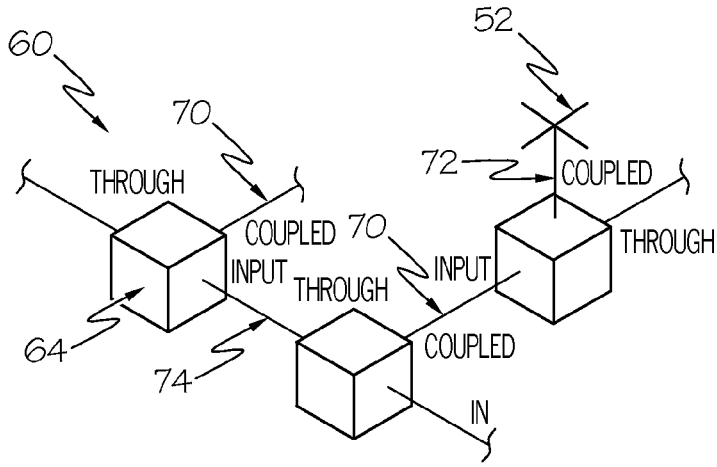
FIG. 15 is a general schematic illustration representing coupler connections in accordance with one embodiment of the present invention.

The schematic illustration in FIG. 15 represents an example of a connection method of the couplers 64 along a main feed line 74 and a primary feed line 70. Starting along the main feed line 74, a first coupler is electrically connected in series to the succeeding coupler by connecting the through output of the first coupler to the input of the succeeding coupler. This connection is repeated along the main feed line 74 until all of the couplers along the main feed line 74 are connected in series. The coupled output of each coupler along the main feed line is connected to an individual primary feed line 70. Now moving along the primary feed line 70, the first coupler along the primary feed line is electrically connected in series to a succeeding coupler in the same manner as the couplers located on the main feed line 74. The coupled output of the couplers along the primary feed line 70 are connected to an antenna element 52 via secondary feed lines 72.

To obtain improved gain control, the couplers 64 may be adjusted so that the network 60 has an equal power distribution among all of the antenna elements of the antenna array 12, 22, 32. In other instances, the designer of an array will not want equal power distribution. For example, in accordance with the present invention, tapering the amplitude over the array can be used to control the sidelobe structure, and shifting the phase over the array can be used to point the beam off the broadside direction. The desired power distribution among the antenna elements is achieved by calculating the required coupling coefficient of each individual coupler 64 in the transmission network 60. The main line outputs, the branch line outputs and antenna element power may be calculated by the following equations:

$$O_{MLm} = C_{MLm} + \sum_{1}^{m-1} T_{MLm}$$

$$O_{PLn} = C_{PLn} + \sum_{1}^{n-1} T_{PLn}$$

$$F_{mn} = O_{MLm} + O_{PLn}$$

The units of the above equation are in dB, where $O_{MLm}$ is the output of the various couplers along the main feed line 74, $C_{MLm}$ is the coupling output of the various couplers 64 along the main feed line 74, and $T_{MLm}$ is the through output of the couplers 64 along the main feed line 74. Similarly, $O_{PLn}$ is the output of the various couplers along the primary feed line 70, $C_{PLn}$ is the coupling output of the various couplers along the primary feed line 70, and $T_{PLn}$ is the through output of the couplers along the primary feed line 70. Finally, $F_{mn}$ is the calculated power delivered to each antenna element. The coupling coefficients of each individual coupler 64 are then adjusted to each individual coupler's respective calculated coupling coefficient.

Figure 16:
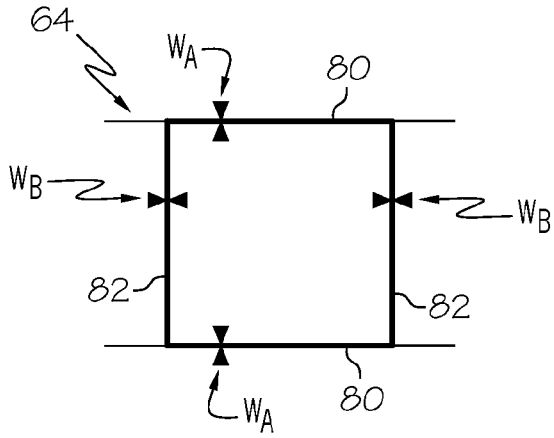
FIG. 16 is a general schematic illustration of a quadrature hybrid coupler in accordance with one embodiment of the present invention.

FIG. 16 illustrates one embodiment in which the couplers 64 comprise quadrature hybrid couplers. The coupling ratio between the through and coupled output is controlled by adjusting widths $W_A$ and $W_B$ of a first coupler conductor 80 and second coupler conductor 82, respectively. By adjusting the widths $W_A$ and $W_B$, the impedance characteristics of conductors 80 and 82, respectively, are changed. The impedances $Z_{oA}$ and $Z_{oB}$ of the conductors can be calculated using standard microstrip design formulas. The widths $W_A$ and $W_B$ may be selected to achieve an equal power distribution among the antenna elements. The use of couplers with precise coupling coefficients allow for actual coupling coefficients that are close to the calculated coupling coefficients, thus permitting the use of a thin substrate 18 and 28 with both a low loss and a low relative dielectric resulting in a balanced transmission line.

It is apparent that many other coupler types may be used in accordance with the present invention. For example, a two-line coupler with may also be used. In adherence to general design requirements for arrays, it is also contemplated that the particular coupler used should be characterized by a precise coupling coefficient that does not vary from its designed coupling coefficient by more than about 10%.

Figure 17:
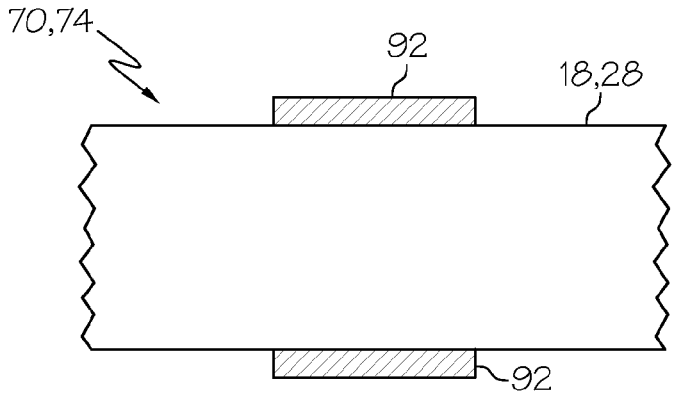
FIG. 17 is a cross-sectional view of a transmission line in accordance one embodiment of the present invention.

FIG. 17 is an illustration of one embodiment of the various feed lines of the transmission network 60. The feed lines comprise strip conductors 92 printed on a low loss dielectric substrate 18 and 28. Each side of the transmission line is identical. This design results in a more balanced transmission line to each antenna element, eliminates a ground plane which would degrade transmissivity, and allows for control of the transmission line impedance to obtain a better match between the impedance of the transmission lines and the impedance of the antenna elements. The transparent characteristics of the transmission networks 60 may be enhanced by minimizing the total area of the various feed lines of the network 60.

Figure 18:
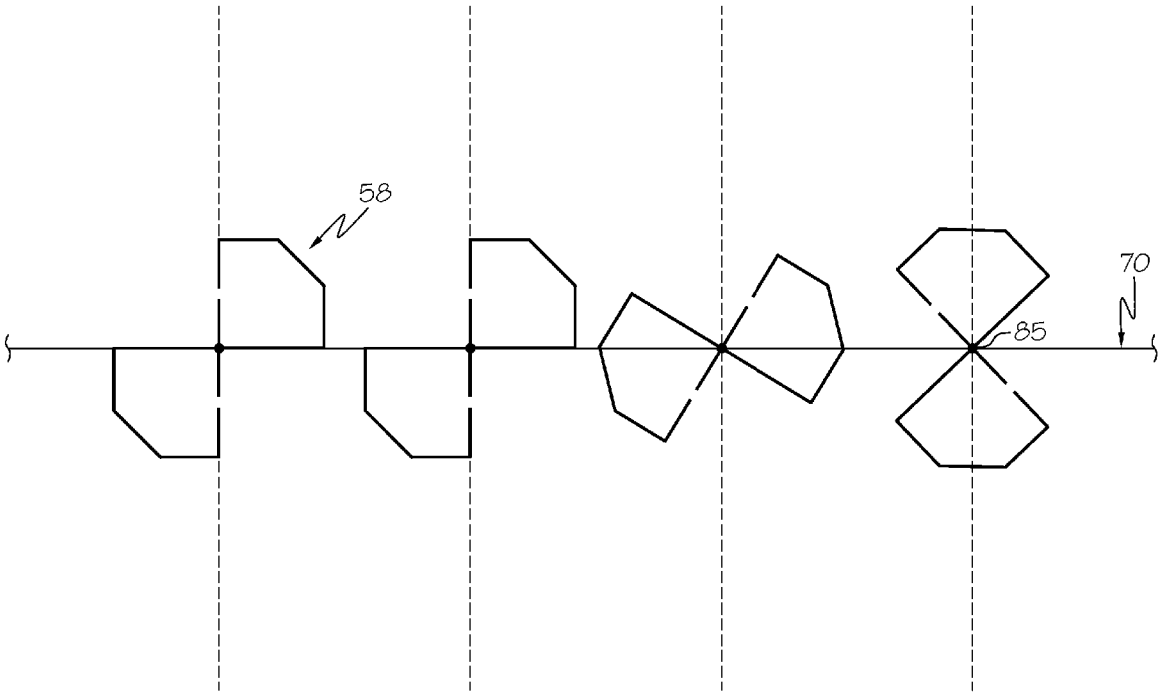
FIG. 18 illustrates rotated elements in accordance with one embodiment of the present invention.

As illustrated in FIG. 18, the circularly polarized antenna elements 58 can be rotated relative to one another about a phase control axis 85 that is orthogonal to the plane of the antenna array 12 and 22 so that the circularly polarized antenna elements 58 are in phase with one another at a designed frequency. It is contemplated that a phase distribution other than an equal phase distribution may be desired and obtained in accordance with the present invention. For example, a design in accordance with the present invention may not require that the elements are rotated to correct the phase. The four circularly polarized antenna elements 58 are demonstrated in FIG. 18 as an example. It is apparent that other various shaped antenna elements may be used. The rotation of the circularly polarized antenna elements 58 may be required to correct an unequal phase distribution that is due to the different distances between the input and the individual feed point for the circularly polarized antenna elements 58. To accommodate the rotated circularly polarized antenna elements 58, the primary feed line 70 and the dielectric substrate 18 and 28 are twisted with respect to the plane of the couplers. More specifically, by way of illustration and not limitation, a substrate for the transmission line should be chosen that allows for deformation without additional resistance.

Having described the invention in detail and by reference to specific embodiments thereof, it will be apparent that modifications and variations are possible without departing from the scope of the invention defined in the appended claims. For example, although the present invention is described in the context of antenna assemblies that overlap within a radome, this contextual description should not be taken as an implication that the present invention is limited to particular array geometries or to antenna systems where the antenna assemblies move relative to each other. It is contemplated that antenna arrays of the present invention may be configured as flat arrays, curved arrays, spherical section arrays, etc. and as arrays that move relative to each other or remain in a fixed "stack" of antenna arrays.

For the purposes of describing and defining the present invention, it is noted that an antenna is a device that is designed to transmit electromagnetic energy by converting electric signals propagating along a transmission line into electromagnetic waves, receive electromagnetic energy by converting electromagnetic waves into electric signals propagating along a transmission line, or transmit and receive electromagnetic energy.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. Furthermore, although some aspects of the present invention are identified herein as preferred or particularly advantageous, it is contemplated that the present invention is not necessarily limited to these preferred aspects of the invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

What is claimed is:

1. An antenna system comprising at least two antenna assemblies, wherein:

a first antenna assembly of said antenna system is tuned to a first frequency band ν1 and comprises a first array of antenna elements rotatable about a phase control axis orthogonal to the plane of the first array, a first electrical ground plane electromagnetically coupled to said first array of antenna elements, and a first transmission network conductively coupled to said first array of antenna elements;

a second antenna assembly of said antenna system is tuned to a second frequency band ν2;

said first ground plane is configured as a frequency selective surface that is substantially reflective of radiation in said first frequency band ν1 and substantially transparent to radiation in said second frequency band ν2; and said first and second antenna assemblies are incorporated within said antenna system such that said first antenna assembly is positioned to at least partially obstruct the field of view of said second antenna assembly;

said first transmission network is substantially transparent to radiation in said second frequency band ν2 and comprises a primary feed line, a plurality of secondary feed lines, and a plurality of couplers; said secondary feed lines are connected to individual ones of said antenna elements; said secondary feed lines are coupled to said primary feed line via said couplers; and said couplers are electrically connected in series along said primary feed line.

2. An antenna system as claimed in claim 1 wherein:

said frequency tuning of said first antenna assembly is substantially independent of the configuration of said second antenna assembly; and said frequency tuning of said second antenna assembly is substantially independent of the configuration of said antenna elements, said ground plane, and said transmission network of said first antenna assembly.

3. An antenna system as claimed in claim 1 wherein:

said frequency tuning of said first antenna assembly is substantially independent of the position of said second antenna assembly; and said frequency tuning of said second antenna assembly is substantially independent of the position of said first antenna assembly.

4. An antenna system as claimed in claim 1 wherein said frequency selective surface of said first ground plane is arranged as a periodic, one or two dimensional array of substantially identical ground plane elements.

5. An antenna system as claimed in claim 4, wherein said substantially identical ground plane elements comprise slot elements formed in a conductive layer or conductive elements supported by a dielectric structure.

6. An antenna system as claimed in claim 4 wherein said array of substantially identical ground plane elements of said first ground plane is configured such that said antenna elements of said first array of antenna elements are positioned to avoid overlap with said ground plane elements of said first ground plane.

7. An antenna system as claimed in claim 6 wherein conductive lines of said first transmission network are further configured to avoid overlap with said array of substantially identical ground plane elements.

8. An antenna system as claimed in claim 1 wherein said second antenna assembly comprises a second ground plane configured as a frequency selective surface that is substantially reflective of radiation in said second frequency band.

9. An antenna system as claimed in claim 1 wherein said second antenna assembly comprises a second ground plane configured as a frequency selective surface that is substantially reflective of radiation in said second frequency band and substantially transparent to radiation in an additional frequency band.

10. An antenna system as claimed in claim 1 wherein said first array of antenna elements is configured as a planar array, a flat array, a curved array, a spherical section array or combinations thereof.

11. An antenna system as claimed in claim 1 wherein said antenna system is configured such that said first and second antenna assemblies define respective fields of view that can be oriented independently of each other through movement of at least one of said antenna assemblies within said antenna system.

12. An antenna system as claimed in claim 1 wherein said first antenna assembly is configured as a unitary multi-layered structure comprising, as multi-layer components, said array of antenna elements, said electrical ground plane, said transmission network, and one or more dielectric layers.

13. An antenna system as claimed in claim 1 wherein a dielectric gap spacing said first electrical ground plane from said first array of antenna elements is about one-quarter of a wavelength of said first frequency band ν1.

14. An antenna system as claimed in claim 1 wherein:

said first electrical ground plane is spaced from said first away of antenna elements by a dielectric gap that is less than a wavelength of said first frequency band ν1.

15. An antenna system as claimed in claim 1 wherein:

said first ground plane comprises an array of slot elements formed in a conductive layer; and said first transmission network comprises a network of micro-strip or co-planar waveguide transmission lines configured to utilize said conductive layer of said first ground plane as an electrical ground.

16. An antenna system as claimed in claim 1 wherein:

said first ground plane comprises an array of conductive elements supported by a dielectric structure; and said first transmission network comprises a co-axial cable network or a network of transmission lines implemented as components of a unitary multi-layer structure in said first antenna assembly.

17. An antenna system as claimed in claim 1 wherein individual elements of said first array of antenna elements distribute energy through said couplers from said primary feed line of said first transmission network.

18. An antenna system as claimed in claim 17 wherein said couplers are configured with varying degrees of energy coupling between said primary feed line and respective antenna elements across said first array of antenna elements.

19. An antenna system as claimed in claim 1 wherein said antenna system is configured such that said first antenna assembly is positioned to at least partially obstruct a field of view defined by said second antenna assembly.

20. An antenna system as claimed in claim 19 wherein said first and second antenna assemblies are configured such that the functionality of said second antenna assembly is substantially independent of the degree to which said first antenna assembly obstructs the field of view defined by said second antenna assembly.

21. An antenna system as claimed in claim 19 wherein said antenna system further comprises an additional antenna assembly and said first and second antenna assemblies are positioned to at least partially obstruct a field of view defined by said additional antenna assembly.

22. An antenna system as claimed in claim 1 wherein respective coupling coefficients of said couplers establish a substantially equal power distribution among said antenna elements of said transmission network.

23. An antenna system as claimed in claim 1 wherein:

a through port of an individual coupler of said couplers is connected to an input of a succeeding coupler of said couplers along said branch line; and a coupled port of said individual coupler is connected to an individual secondary feed line of said secondary feed lines.

24. An antenna system as claimed in claim 1 wherein:

said first transmission network comprises a plurality of branch lines, each branch line comprising a primary feed line, a plurality of secondary feed lines, and a plurality of couplers;

said branch lines are coupled along a main feed line via respective couplers; and said couplers are electrically connected in series along said main feed line.

25. An antenna system as claimed in claim 24 wherein:

said first transmission network comprises a plurality of sections, each comprising a main feed line and a plurality of branch lines.

26. An antenna system as claimed in claim 25 wherein:

said first transmission network comprises four of said sections; and said sections are orthogonally joined.

27. An antenna system as claimed in claim 1 wherein said couplers comprise quadrature hybrid couplers.

28. An antenna system as claimed in claim 1 wherein a plurality of circularly polarized antenna elements are rotated relative to one another about a phase control axis orthogonal to the plane of said first array of antenna elements such that said circularly polarized antenna elements acquire a substantially equal phase at a designed frequency.

29. An antenna system comprising at least three antenna assemblies, wherein:

a first antenna assembly of said antenna system is tuned to a first frequency band ν1 and comprises a first away of antenna elements, a first electrical ground plane electromagnetically coupled to said first array of antenna elements, and a first transmission network conductively coupled to said first array of antenna elements;

a second antenna assembly of said antenna system is tuned to a second frequency band ν2 and comprises a second away of antenna elements, a second electrical ground plane electromagnetically coupled to said second array of antenna elements, and a second transmission network conductively coupled to said second array of antenna elements;

a third antenna assembly of said antenna system is tuned to a third frequency band ν3 and comprises a third array of antenna elements, a third electrical ground plane electromagnetically coupled to said third away of antenna elements, and a third transmission network conductively coupled to said third away of antenna elements;

said third electrical ground plane is spaced from said third away of antenna elements by a dielectric gap that is less than a wavelength of said third frequency band ν3;

said first ground plane is configured as a frequency selective surface that is substantially transparent to radiation in said second frequency band ν2 and substantially transparent to radiation in said third frequency band ν3;

said second ground plane is configured as a frequency selective surface that is substantially reflective of radiation in said second frequency band ν2 and substantially transparent to radiation in said third frequency band ν3;

said first and second antenna assemblies are incorporated within said antenna system such that said first antenna assembly is positioned to at least partially obstruct the field of view of said second antenna assembly; and said third antenna assembly is incorporated within said antenna system such that said first or second antenna assembly is positioned to at least partially obstruct the field of view of said third antenna assembly.

30. An antenna system as claimed in claim 29 wherein said third ground plane is configured to be substantially reflective of radiation in said third frequency band.

31. An antenna system as claimed in claim 29, wherein a dielectric gap spacing said second electrical ground plane from said second array of antenna elements is about one-quarter of a wavelength of said second frequency band ν2.

32. An antenna system as claimed in claim 29, wherein:

said first transmission network is substantially transparent to radiation in said second frequency band ν2 and said third frequency band ν3; and said second transmission network is substantially transparent to radiation in said third frequency band ν3.

33. An antenna system as claimed in claim 32, wherein:

said first transmission network comprises a primary feed line, a plurality of secondary feed lines, and a plurality of couplers;

said secondary feed lines are connected to individual ones of said antenna elements;

said secondary feed lines are coupled along said primary feed line via said couplers;

said couplers are electrically connected in series along said feed line;

said second transmission network comprises a primary feed line, a plurality of secondary feed lines, and a plurality of couplers;

said secondary feed lines are connected to individual ones of said antenna elements;

said secondary feed lines are coupled along said primary feed line via said couplers; and said couplers are electrically connected in series along said feed line.

34. An antenna system comprising at least two antenna assemblies, wherein:

a first antenna assembly of said antenna system is tuned to a first frequency band v1 and comprises a first array of antenna elements rotatable about a phase control axis orthogonal to the plane of the first array, a first electrical ground plane electromagnetically coupled to said first array of antenna elements, and a first transmission network conductively coupled to said first array of antenna elements;

a second antenna assembly of said antenna system is tuned to a second frequency band v2;

said first ground plane is configured as a frequency selective surface that is substantially reflective of radiation in said first frequency band v1 and substantially transparent to radiation in said second frequency band v2;

said first and second antenna assemblies are incorporated within said antenna system such that said first antenna assembly is positioned to at least partially obstruct the field of view of said second antenna assembly; and said first transmission network comprises T-junction power dividers through which individual elements of said first array of antenna elements distribute energy from a primary feed line of said first transmission network.

35. An antenna system as claimed in claim 34 wherein said T-junction power dividers are configured with varying degrees of power ratio division between said primary feed line and respective antenna elements across said first array of antenna elements arrays.

36. An antenna system as claimed in claim 35 wherein said first transmission network comprises quarter wavelength transformers through which individual elements of said first array of antenna elements arrays distribute energy from said primary feed line of said first transmission network.

* * * * *

UNITED STATES PATENT AND TRADEMARK OFFICE

CERTIFICATE OF CORRECTION

PATENT NO. : 7,576,696 B2
APPLICATION NO. : 11/457327
DATED : July 13, 2006
INVENTOR(S) : Walton et al.

It is certified that error appears in the above-identified patent and that said Letters Patent is hereby corrected as shown below:

Col. 11, Line 5 "away of antenna elements" should read --array of antenna elements--;

Col. 12, Line 16 "away of" should read --array of--;

Col. 12, Line 23 "away of antenna elements," should read --array of antenna elements,--;

Col. 12, Line 31 "away of antenna," should read --array of antenna--;

Col. 12, Line 33 "away of antenna elements;" should read --array of antenna elements;--; and Col. 12, Line 35 "away of antenna elements" should read --array of antenna elements--.

Signed and Sealed this

Ninth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,576,696 B2
APPLICATION NO. : 11/457327
DATED : August 18, 2009
INVENTOR(S) : Walton et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 366 days.

Signed and Sealed this

Seventh Day of September, 2010

David J. Kappos

David J. Kappos
*Director of the United States Patent and Trademark Office*